US008063827B2

(12) United States Patent
Hotta et al.

(10) Patent No.: US 8,063,827 B2
(45) Date of Patent: Nov. 22, 2011

(54) ANTENNA DEVICE AND RADIO APPARATUS OPERABLE IN MULTIPLE FREQUENCY BANDS

(75) Inventors: Hiroyuki Hotta, Tokyo (JP); Masao Teshima, Tokyo (JP)

(73) Assignee: Kabushiki Kaisha TOSHIBA, Tokyo (JP)

( * ) Notice: Subject to any disclaimer, the term of this patent is extended or adjusted under 35 U.S.C. 154(b) by 549 days.

(21) Appl. No.: 12/142,050

(22) Filed: Jun. 19, 2008

(65) Prior Publication Data

US 2009/0189815 A1 Jul. 30, 2009

(30) Foreign Application Priority Data

Jan. 30, 2008 (JP) ..... 2008-019299

(51) Int. Cl.
*H01Q 1/38* (2006.01)

(52) U.S. Cl. ..... 343/700 MS; 343/702; 343/741; 343/846; 343/895

(58) Field of Classification Search ..... 343/700 MS, 343/702, 833, 834, 846, 895
See application file for complete search history.

(56) References Cited

U.S. PATENT DOCUMENTS 6,326,921 B1 * 12/2001 Egorov et al. ..... 343/700 MS
6,614,400 B2 * 9/2003 Egorov ..... 343/702
6,714,162 B1 * 3/2004 Kadambi et al. ..... 343/700 MS
7,136,022 B2 * 11/2006 Sato et al. ..... 343/702
7,205,942 B2 * 4/2007 Wang et al. ..... 343/700 MS
7,319,432 B2 * 1/2008 Andersson ..... 343/702
7,477,199 B2 * 1/2009 Hotta et al. ..... 343/702
7,495,620 B2 * 2/2009 Wang et al. ..... 343/702
7,619,572 B2 * 11/2009 Su et al. ..... 343/702
7,652,633 B2 * 1/2010 Mai et al. ..... 343/833
7,701,401 B2 * 4/2010 Suzuki et al. ..... 343/702
2007/0057849 A1 * 3/2007 Moon et al. ..... 343/700 MS

FOREIGN PATENT DOCUMENTS

JP 2004-172912 A 6/2004
JP 2004-201278 A 7/2004

* cited by examiner

*Primary Examiner* — Douglas W Owens
*Assistant Examiner* — Chuc Tran
(74) *Attorney, Agent, or Firm* — Holtz, Holtz, Goodman & Chick, PC

(57) ABSTRACT

An antenna device usable in a radio apparatus including a printed board includes a ground conductor of the printed board, a first partial element, a second partial element and a parasitic element. The first partial element is shaped into an area having a first side facing a side of the ground conductor and a second side directed to cross the side of the ground conductor, and is provided with a feed portion around a first end of the first side being closer to the second side. The second partial element branches off from the first partial element around one of two ends of the second side being farther from the feed portion, and is directed almost against a direction from the feed portion to a second end of the first side being farther from the second side. The parasitic element has an end grounded around the second end.

18 Claims, 11 Drawing Sheets

(LENGTHS IN *mm*)

(LENGTHS IN *mm*)

(LENGTHS IN *mm*)

ANTENNA DEVICE AND RADIO APPARATUS OPERABLE IN MULTIPLE FREQUENCY BANDS

CROSS REFERENCE TO RELATED APPLICATIONS

This application is based upon and claims the benefit of priority from the prior Japanese Patent Application No. 2008-19299 filed on Jan. 30, 2008;
the entire contents of which are incorporated herein by reference.

BACKGROUND OF THE INVENTION

1. Field of the Invention

The present invention relates to an antenna device and a radio apparatus operable in multiple frequency bands, and in particular to a built-in type antenna device and a radio apparatus including the antenna device.

2. Description of the Related Art

There is a trend that mobile phones or personal computers (PCs) having radio capability have multiple purposes and multiple functions. The above trend requires an antenna device which may be operable in multiple frequency bands or in a broad frequency range.

In order to meet the above requirement, antenna devices designed to have multiple resonant frequencies (to be operable in multiple frequency bands) or to be operable in a broad frequency range are disclosed, e.g., in Japanese Patent Publication of Unexamined Applications (Kokai), No. 2004-172912 or No. 2004-201278.

More specifically, JP 2004-172912 discloses a multi-frequency (multi-band) antenna of an inverted F type formed by a feeding line, a short-circuiting line and a first open-ended line. The antenna of JP 2004-172912 further has a second open-ended line almost shaped into a rectangle and arranged on an opposite side of the feeding line as viewed from the first open-ended line. According to JP 2004-172912, it has been estimated by simulation that the antenna configured as described above may have resonances, e.g., at a 2.4 gigahertz (GHz) band and at a 5.2 GHz band.

JP 2004-201278 discloses a pattern antenna including an inverted F type antenna, an inverted L type antenna and a ground conductor which are conductive patterns formed on a surface of a printed board. The inverted F type antenna may be fed and excited. The inverted L type antenna is arranged to nearly surround the inverted F type antenna and may be excited as a parasitic element. According to JP 2004-201278, resonant frequencies of the inverted F type antenna and the inverted L type antenna may be determined by their element lengths so that the pattern antenna may have at least two resonant frequencies.

JP 2004-172912 discloses an embodiment of the multi-band antenna applied to a wireless local area network (WLAN). The arrangement of the second open-ended line being nearly rectangular and the first open-ended line on the one side and on the other side of the feeding line, respectively, may cause a parallel resonance. If the multi-band antenna is used in a lower frequency band such as a mobile phone antenna, the parallel resonance may disturb a broadband characteristic there.

As described above, the parasitic element of the pattern antenna of JP 2004-201278 is arranged to nearly surround the inverted F antenna of an element length being shorter than the length of the parasitic element. It may thus be understood, according to a paragraph "0035" of JP 2004-201278, that the inverted F antenna is arranged close to the parasitic element along a whole element length of the inverted F antenna.

If an element to be fed and a parasitic element are arranged in positions relative to each other as described above, though, it may be difficult to excite the parasitic element at a desired frequency due to effects of a voltage-coupling and a current-coupling which may cancel each other. If open ends of both of the elements are arranged separate in order to avoid such difficulty, it may be difficult to shape a radio apparatus including the elements as a built-in antenna into a low profile configuration.

SUMMARY OF THE INVENTION

Accordingly, an object of the present invention is to provide an antenna device including two partial elements and a parasitic element adapted for multiple resonances, while avoiding occurrence of a parallel resonance or factors of disturbing a low profile configuration, by selecting positions of each of the partial elements and the parasitic element relative to one another.

To achieve the above advantage, according to one aspect of the present invention, an antenna device usable in a radio apparatus including a printed board is provided. The antenna device includes a printed board includes a ground conductor of the printed board, a first partial element, a second partial element and a parasitic element. The first partial element is shaped into an area having a first side facing a side of the ground conductor and a second side directed to cross the side of the ground conductor, and is provided with a feed portion around a first end of the first side being closer to the second side. The second partial element branches off from the first partial element around one of two ends of the second side being farther from the feed portion, and is directed almost against a direction from the feed portion to a second end of the first side being farther from the second side. The parasitic element has an end grounded around the second end.

DETAILED DESCRIPTION OF THE INVENTION

Figure 1:
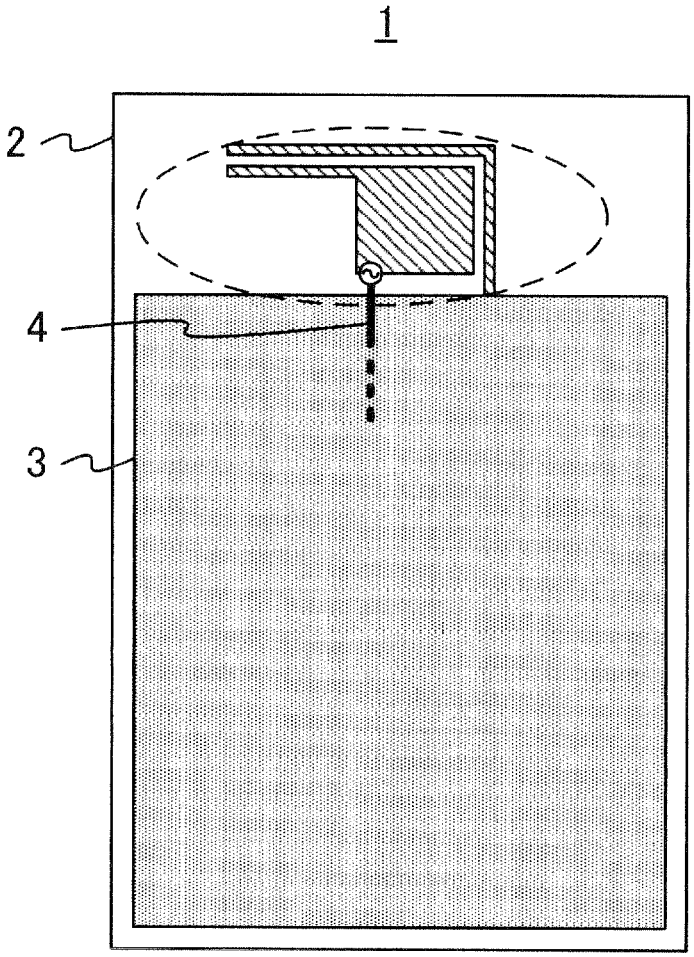
FIG. 1 is a plan view showing a configuration of an antenna device of a first embodiment of the present invention.

Hereinafter, embodiments of the present invention will be described in detail. In following descriptions, terms like upper, lower, left, right, horizontal or vertical used while referring to a drawing shall be interpreted on a page of the drawing unless otherwise noted. Besides, a same reference numeral given in no less than two drawings shall represent a same member or a same portion.

A first embodiment of the present invention will be described with reference to FIGS. 1-21. FIG. 1 is a plan view showing a configuration of an antenna device 1 of the first embodiment. The antenna device 1 may be used as a built-in antenna of a radio apparatus (not shown). The radio apparatus has a printed board 2 shown in FIG. 1.

The antenna device 1 includes a ground conductor 3 of the printed board 2 and an antenna element (including plural partial elements described later) arranged close to the ground conductor 3. The antenna element is connected to a radio circuit (not shown) through a feeding line 4 provided on the ground conductor 3. The printed board 2 may be made of flexible material.

The above antenna element may be formed by conductive patterns of the printed board 2, e.g., shown as encircled by a dashed ellipse in FIG. 1. As long as located close to the ground conductor 3, the antenna element may be formed by other than the conductive pattern of the printed board 2. The feeding line 4 is formed, e.g., by a coaxial cable but may be by another kind of cabling material, or by a coplanar line of a conductive pattern of the printed board 2.

Figure 2:
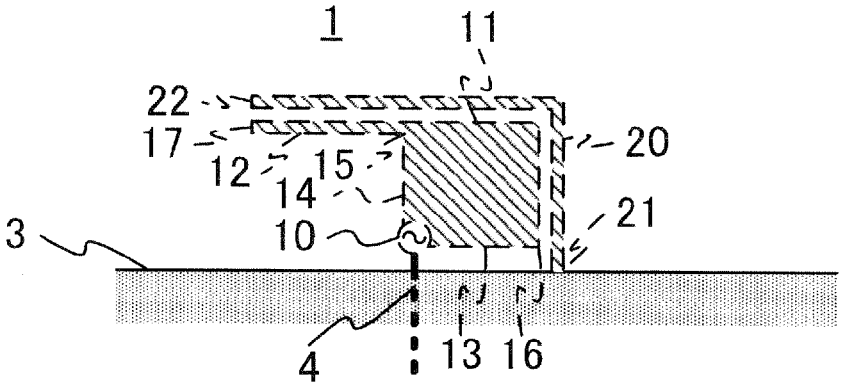
FIG. 2 is a plan view showing a configuration and a shape of a main portion of the antenna device of the first embodiment.

FIG. 2 is a plan view showing a configuration and a shape of a main portion of the antenna device 1 in detail. The above antenna element of the antenna device 1 includes a first partial element 11 provided with a feed portion 10 and connected to the feeding line 4, a second partial element 12 which branches off from the first partial element 11, and a parasitic element 20.

The first partial element 11 is shaped into a planar area having a lower side 13 facing a side of the ground conductor 3 and a left side 14 directed to cross the side of the ground conductor 3. The feed portion 10 is located close to a left end of the lower side 13 of the first partial element 11.

The second partial element 12 branches off from the first partial element 11 at a branch portion 15 which is an upper end of the left side 14 of the first partial element 11, being far from the feed portion 10 on the left side 14. The second partial element 12 is directed leftward from the branch portion 15, i.e., directed almost against a direction from the feed portion 10 to a right end 16 of the lower side 13 of the first partial element 11.

The parasitic element 20 has a grounded end 21 being short-circuited to the ground conductor 3 around the right end 16 of the lower side 13 of the first partial element 11. Another end of the parasitic element 20 is an open end 22 located close to an end 17 of the second partial element 12.

If the antenna device 1 is fed at the feed portion 10, radio frequency (RF) currents are excited and distributed along several paths, three of which will be explained with reference to FIGS. 3-5. Each of FIGS. 3-5 shows again a shape of the antenna element of the antenna device 1, while omitting to show the ground conductor 3.

Figure 3:
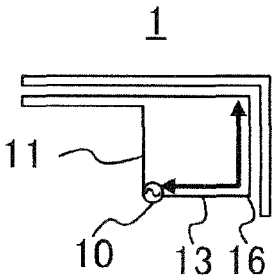
FIG. 3 is an explanatory diagram of the antenna device of the first embodiment showing a path along which an RF current is distributed if the antenna device is fed.

If the antenna device 1 is fed at the feed portion 10, an RF current is distributed along a path as indicated in FIG. 3 by a line with arrows at both ends. The path is formed by the lower side 13 and a right side of the first partial element 11, i.e., from the feed portion 10 via the right end 16 to an upper end of the right side.

By means of the RF current distributed along the path shown in FIG. 3, the antenna device 1 may be resonant at a frequency referred to as F3 at which the path shown in FIG. 3 is a quarter wavelength long.

Figure 4:
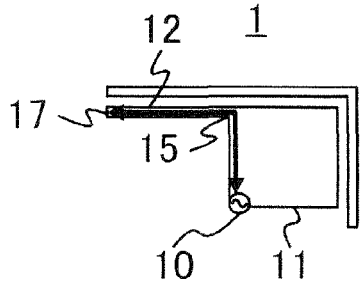
FIG. 4 is another explanatory diagram of the antenna device of the first embodiment showing another path along which an RF current is distributed if the antenna device is fed.

If the antenna device 1 is fed at the feed portion 10, an RF current is distributed along a path as indicated in FIG. 4 by a line with arrows at both ends. The path is formed by the left side 14 and the second partial element 12, i.e., from the feed portion 10 via the branch portion 15 to the end 17 of the second partial element 12.

By means of the RF current distributed along the path shown in FIG. 4, the antenna device 1 may be resonant at a frequency referred to as F4 at which the path shown in FIG. 4 is a quarter wavelength long.

Figure 5:
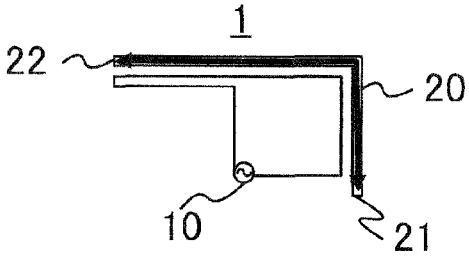
FIG. 5 is yet another explanatory diagram of the antenna device of the first embodiment showing yet another path along which an RF current is distributed if the antenna device is fed.

If the antenna device 1 is fed at the feed portion 10, an RF current is distributed along a path as indicated by a line with arrows at both ends in FIG. 5. The path is between the open end 22 and the grounded end 21 of the parasitic element 20.

If the open end 22 of the parasitic element 20 is voltage-coupled to the end 17 of the second partial element 12, the RF current is distributed along the path shown in FIG. 5. Consequently, the antenna device 1 may be resonant at a frequency referred to as F5 at which the path shown in FIG. 5 is a quarter wavelength long.

According to the configuration and the shape of the antenna device 1 as described above, the paths shown in FIGS. 3-5 do not overlap one another. Hence, even if the length of one of the paths is changed and so is the resonant frequency associated with that path, the other resonant frequencies may be affected little. In other words, each of the resonant frequencies may be determined by the associated path length independently.

If the path along the parasitic element 20 shown in FIG. 5, e.g., is longest among the above three paths, F5 is lowest among the resonant frequencies F3-F5. In order to implement the resonant frequency F5, the antenna device 1 could have an additional open-ended partial element being a quarter wavelength long and branching off from some portion of the first partial element 11, instead of the parasitic element 20.

The above additional element branching off from the first partial element 11, however, may cause a parallel resonance between the end of the additional element and the end 17 of the second partial element 12 at a frequency between F5 and F4, and may disturb a broadband characteristic of the antenna device 1.

The antenna device 1 may avoid such a problem by assigning the lowest resonant frequency to the parasitic element 20. The antenna device 1 may implement a resonant frequency at least higher than F4 by using a third harmonic of F5 (=3×F5) so as to further broaden the frequency characteristic in a higher frequency range. An effect of the first embodiment in a broadband aspect will be specifically described later with reference to FIGS. 6-12.

The open end 22 is arranged close to the end 17 of the second partial element 12 as described above, and may be voltage-coupled to the end 17 if the antenna device 1 is fed at the feed portion 10. It is necessary to make a distance between the open end 22 and the end 17 small enough to ensure the voltage-coupling.

If the open end 22 is located relatively to the end 17 in a direction parallel to thickness of a housing section of the radio apparatus including the antenna device 1, the above small distance may secondarily contribute to a low profile feature of the housing section. A condition with regard to the above distance between the open end 22 and the end 17 will be specifically described later with reference to FIGS. 13-15.

As a portion of the RF current distribution path faces the side of the ground conductor 3, a distance between the lower side 13 of the first partial element 11 and the side of the ground conductor 3 may possibly affect a characteristic of the antenna device 1 at and around the frequency F3. A condition with regard to the above distance between the lower side 13 of the first partial element 11 and the side of the ground conductor 3 will be specifically described later with reference to FIGS. 16-18.

The grounded end 21 is arranged close to the right end 16 of the lower side 13 of the first partial element 11 as described above. The grounded end 21 should be preferably arranged separate from the feed portion 10 to or more than a certain degree so that a current-coupling possibly canceling an effect of the voltage-coupling may be suppressed. A condition with regard to the above distance between the grounded end 21 and the feed portion 10 will be specifically described later with reference to FIGS. 19-21.

Figure 6:
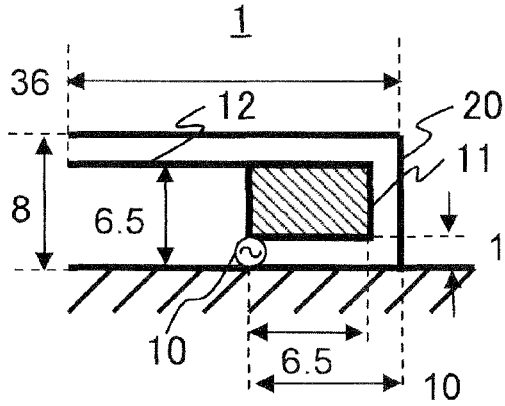
FIG. 6 is a plan view of a model to be estimated by simulation in terms of a broadband characteristic of the antenna device of the first embodiment.

FIG. 6 is a plan view showing a shape and dimensions of a model to be estimated by simulation in terms of the broadband characteristic of the antenna device 1, which is hereinafter called the model 1. In FIG. 6, each of the portions of the configuration and the shape of the antenna device 1 shown in FIG. 2 is indicated with a dimension (in millimeters (mm)) given as a condition of the simulation.

Although each portion given one of the reference numerals 10-12 and 20 is a same as the corresponding one shown in FIG. 2, the other reference numerals shown in FIG. 2 are omitted for simplicity of the drawing in FIG. 6, and thus FIG. 2 should be referred to as necessary.

In FIG. 6, the first partial element 11 is arranged 1 mm apart from the side of the ground conductor 3, and a length from the feed portion 10 to the right end 16 is 6.5 mm. A length from the side of the ground conductor 3 to the upper end of the left side 14, i.e., the branch portion 15, is 6.5 mm. Although not shown in FIG. 6, the second partial element is 26 mm long as described next.

As shown in FIG. 6, the grounded end 21 of the parasitic element 20 is arranged 10 mm apart from the feed portion 10, and the open end 22 is arranged 8 mm apart from the side of the ground conductor 3. The parasitic element 20 is inverted and fallen sideways L shaped.

A horizontal portion of the inverted and fallen sideways L shape of the parasitic element 20 is 1.5 mm apart from, and parallel to, an upper side of the first partial element 11 (or the second partial element 12) facing thereto. A vertical portion of the inverted and fallen sideways L shape is 3.5 mm apart from, and parallel to, the right side of the first partial element 11 facing thereto.

A length from a bend portion of the inverted and fallen sideways L shape to the open end 22 is 36 mm. The open end 22 and the end 17 of the second partial element 12 are vertically on a line. Hence, the length of the second partial element 12 is 10 mm (the distance between the feed portion 10 and the grounded end 21) subtracted from 36 mm, i.e., 26 mm.

The dimensions of the model 1 described above is selected in such a manner that the antenna device 1 may cover nearly 1.5 to 2.7 GHz and 5 to 8 GHz frequency ranges. The nearly 1.5 to 2.7 GHz frequency range may be used for the Global Positioning System (GPS), a third generation (3G) mobile phone service, a wireless local area network (WLAN), a high-speed wireless access network called WiMAX and so on. The nearly 5 to 8 GHz frequency range may be used for an ultra-wide band (UWB) network and so on.

Figure 7:
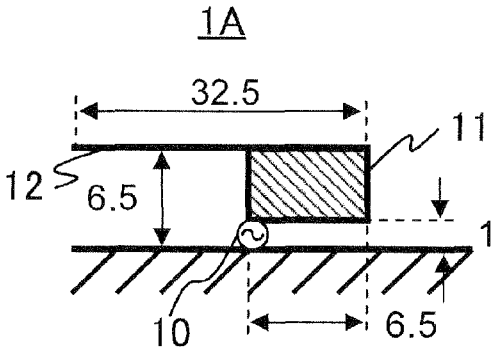
FIG. 7 is a plan view of a model configured by removing a parasitic element from the antenna device of the first embodiment to be compared with the model of FIG. 6.

FIG. 7 is a plan view showing a shape and dimensions of a model configured by removing the parasitic element 20 from the antenna device 1 to be compared with the model 1 in terms of the antenna characteristic, which is hereinafter called the model 1A. Each of portions given one of the reference numerals 10-12 and portions given reference numerals which are not shown in FIG. 7 are same as the corresponding ones of the antenna device 1 shown in FIG. 2 for convenience of explanation.

The shapes, dimensions and positions relative to the ground conductor 3 of the first partial element 11 and the second partial element 12 are same as explained with reference to FIG. 6, and their explanations are omitted.

Figure 8:
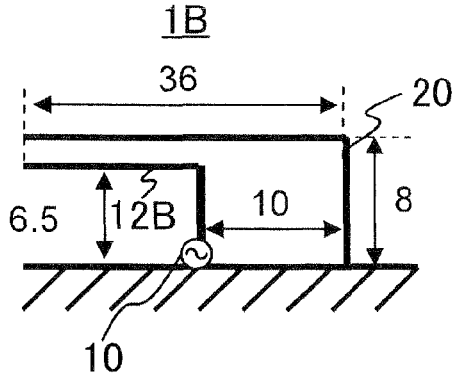
FIG. 8 is a plan view of a model configured by removing a first partial element from the antenna device of the first embodiment and by replacing a second partial element with an inverted and fallen sideways L shaped element.

FIG. 8 is a plan view showing a shape and dimensions of a model configured by removing the first partial element 11 from the antenna device 1 and replacing the second partial element 12 with an inverted and fallen sideways L shaped element 12B which is extended to the feed portion 10, which is hereinafter called the model 1B. For convenience of explanation, a portion given the reference numeral 20 and portions given reference numerals which are not shown in FIG. 7 are same as the corresponding ones of the antenna device 1 shown in FIG. 2.

The inverted and fallen sideways L shaped element 12B is formed by a portion of the first partial element 11 corresponding to the left side 14 and the second partial element 12 joined together. Their shapes, dimensions and positions relative to the ground conductor are same as explained with reference to FIG. 6, and their explanations are omitted.

Figure 9:
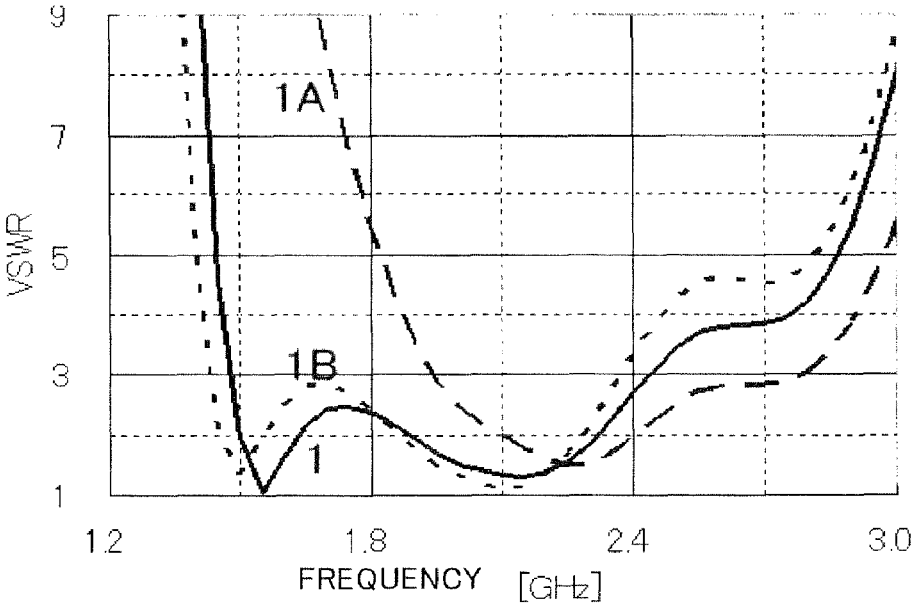
FIG. 9 is a graph of a frequency characteristic of a voltage standing wave ratio (VSWR) of each of the models shown in FIGS. 6-8 in a 1.2 to 3 GHz frequency range.

FIG. 9 is a graph of a frequency characteristic of a voltage standing wave ratio (VSWR) of each of the models 1, 1A and 1B shown in FIGS. 6-8, respectively, estimated by the simulation at the feed portion 10 in a 1.2 to 3 GHz frequency range. FIG. 9 has a horizontal axis and a vertical axis representing the frequencies and the VSWR, respectively. Solid, dashed and dotted curves represent characteristics of the models 1, 1A and 1B, respectively, estimated by the simulation.

Figure 10:
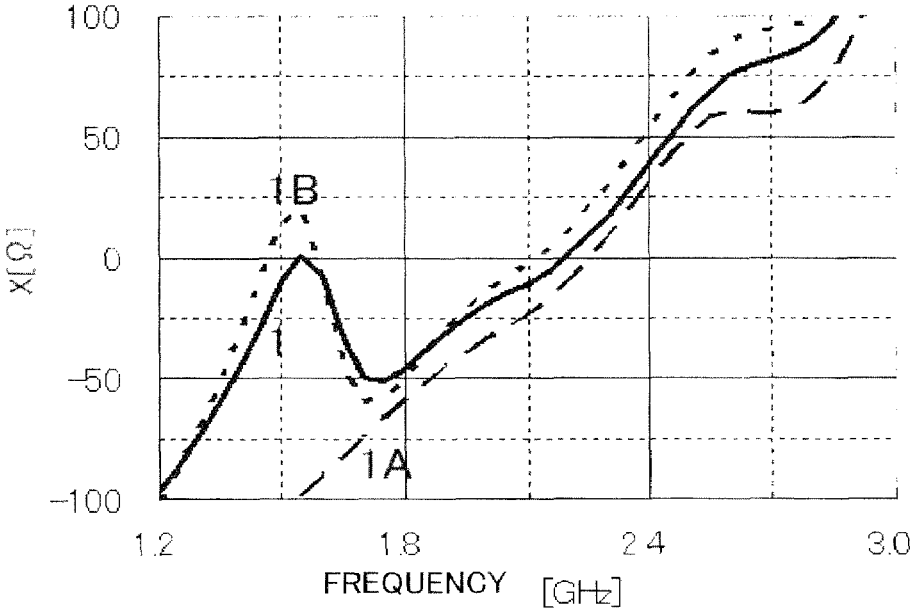
FIG. 10 is a graph of a frequency characteristic of an imaginary part of antenna impedance of each of the models shown in FIGS. 6-8 in the 1.2 to 3 GHz frequency range.

FIG. 10 is a graph of a frequency characteristic of an imaginary part of antenna impedance of each of the models 1, 1A and 1B shown in FIGS. 6-8, respectively, estimated at the feed portion 10 in the 1.2 to 3 GHz frequency range. FIG. 10 has a horizontal axis and a vertical axis representing the frequencies and the imaginary part of the antenna impedance, respectively. Solid, dashed and dotted curves represent characteristics of the models 1, 1A and 1B, respectively, estimated by the simulation.

As shown in FIGS. 9-10, each of the curves of the VSWR reaches a local minimum and each of the curves shown of the imaginary part of the antenna impedance crosses or approaches a horizontal line of a zero value at nearly same frequencies, which correspond to resonant frequencies of the above models.

Starting from a lowest end of the frequency axis of FIGS. 9-10, the models 1 and 1B have resonant frequencies around 1.7 GHz at first. That is a resonant frequency of the parasitic element 20 which the models 1 and 1B have in common, and corresponds to the frequency F5 earlier explained with reference to FIG. 5.

Next, the models 1, 1A and 1B have resonant frequencies around 2.3 GHz. Those resonant frequencies are determined by the RF current path length from the feed portion 10 to the end 17 of the second partial element 12 (the inverted and fallen sideways L shaped element 12B in case of the model 1B), and correspond to the frequency F4 earlier explained with reference to FIG. 4.

If the resonant frequency around 1.7 GHz of the model 1 is implemented not by the parasitic element 20 but by another partial element branching off from the first partial element 11, an effect of a parallel resonance earlier described may possibly cause the impedance to increase and the VSWR to be degraded in a 1.7 to 2.3 GHz frequency range. As using the parasitic element 20 that does not cause a parallel resonance, the model 1 may avoid obvious degradation of the VSWR in the above frequency range and may keep the broadband characteristic.

Figure 11:
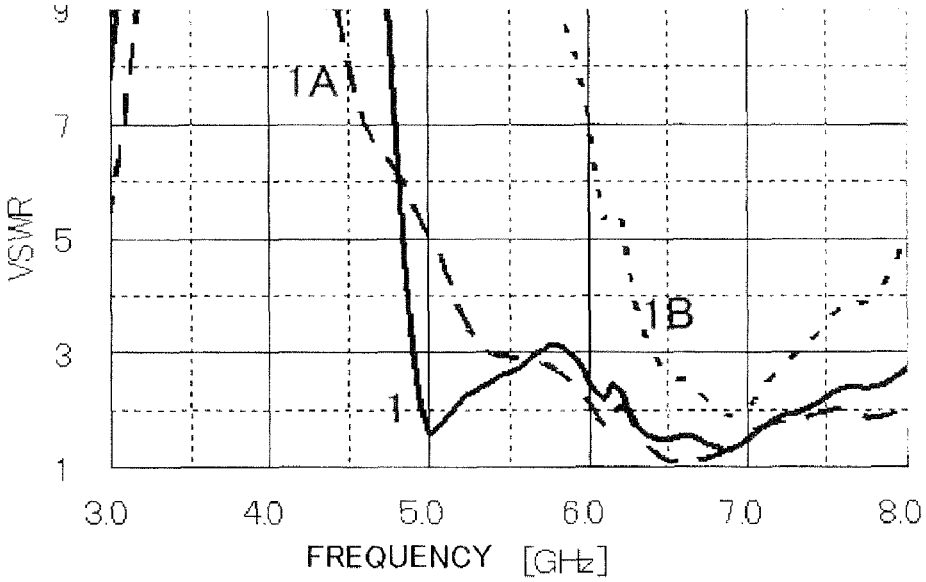
FIG. 11 is a graph of a frequency characteristic of the VSWR of each of the models shown in FIGS. 6-8 in a 3 to 8 GHz frequency range.

FIG. 11 is a graph of a frequency characteristic of the VSWR of each of the above models 1, 1A and 1B, respectively, estimated at the feed portion 10 in a 3 to 8 GHz frequency range. FIG. 11 has a horizontal axis and a vertical axis representing the frequencies and the VSWR, respectively. Solid, dashed and dotted curves represent the characteristics of the models 1, 1A and 1B, respectively, estimated by the simulation.

Figure 12:
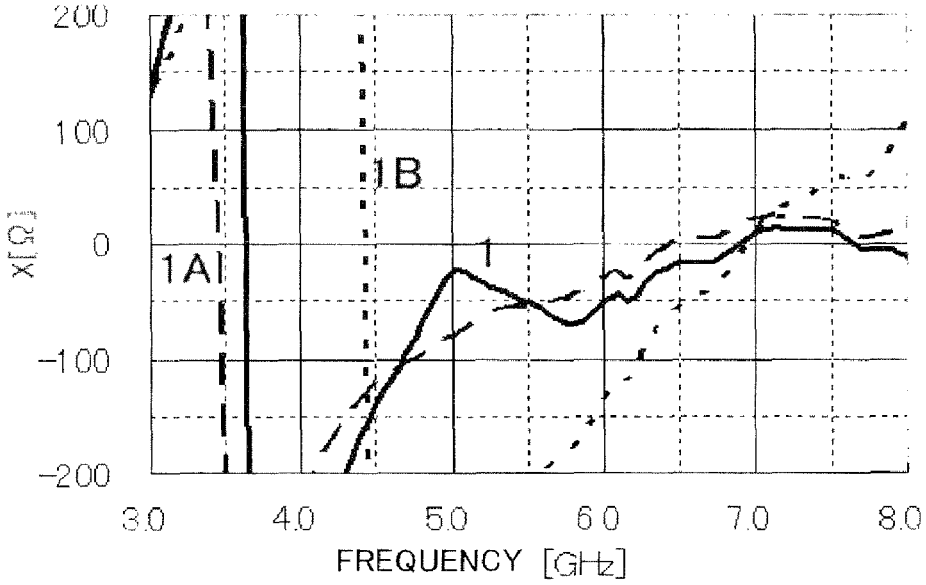
FIG. 12 is a graph of a frequency characteristic of the imaginary part of antenna impedance of each of the models shown in FIGS. 6-8 in the 3 to 8 GHz frequency range.

FIG. 12 is a graph of a frequency characteristic of an imaginary part of antenna impedance of each of the models 1, 1A and 1B shown in FIGS. 6-8, respectively, estimated at the feed portion 10 in the 3 to 8 GHz frequency range. FIG. 12 has a horizontal axis and a vertical axis representing the frequencies and the imaginary part of the antenna impedance, respectively. Solid, dashed and dotted curves represent characteristics of the models 1, 1A and 1B, respectively, estimated by the simulation.

As shown in FIGS. 11-12, each of the curves of the VSWR reaches a local minimum and each of the curves of the imaginary part of the antenna impedance crosses or approaches a horizontal line of a zero value at nearly same frequencies, which correspond to resonant frequencies of the above models.

The model 1 has a resonant frequency around 5 GHz which corresponds to a frequency of a third harmonic wave of a fundamental wave of the parasitic element 20 being resonant around 1.7 GHz. The parasitic element 20 may contribute to the broadband characteristic of the antenna device 1 by using the third harmonic wave.

The third harmonic wave of the parasitic element 20 may probably be excited through the first partial element 11 arranged close to the parasitic element 20 and having a relatively close resonant frequency. Thus, although having the parasitic element 20, the model 1B without the first partial element 11 does not show a resonance of a third harmonic wave as described above.

Next, the models 1, 1A and 1B have resonant frequencies in a nearly 6.5 to 7 GHz frequency range. That is a resonant frequency determined by the RF current path length from the feed portion 10, via the right end 16 of the lower side 13 and to the upper end of the right side of the first partial element 11, and corresponds to the frequency F3 earlier explained with reference to FIG. 3. By means of that resonant frequency, the antenna device 1 may have a broadband characteristic in a frequency band above 5 GHz.

Figure 13:
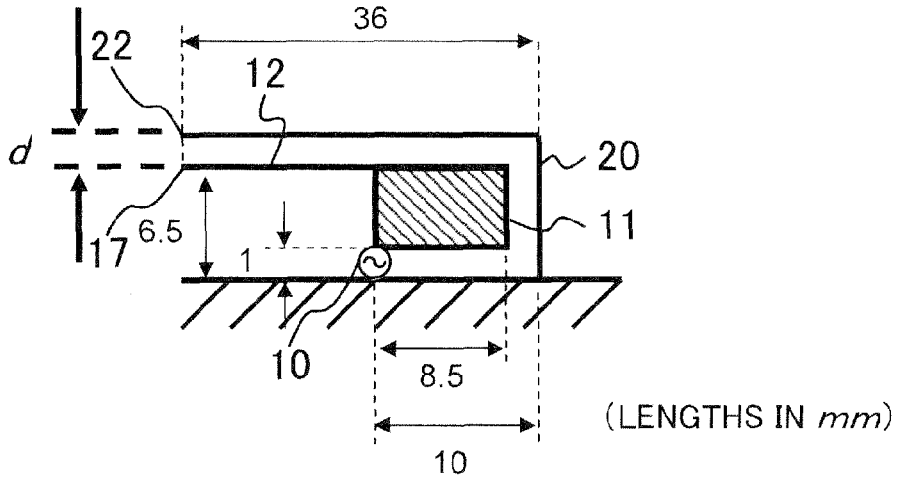
FIG. 13 is a plan view of a model of the antenna device of the first embodiment to be estimated in terms of an effect of a distance "d" between the end of the second partial element and the open end of the parasitic element.

FIG. 13 is a plan view like FIG. 6 showing a shape and dimensions of a model to be estimated by simulation in terms of an effect of the distance between the end 17 of the second partial element 12 and the open end 22 of the parasitic element 20 on the frequency characteristic of the antenna device 1.

The length from the feed portion 10 to the right end 16 of the lower side 13 of the first partial element 11 is 8.5 mm. The separation between the horizontal portion of the parasitic element 20 being inverted and fallen sideways L shaped and the upper side of the first partial element 11 or the second partial element being parallel to the horizontal portion (i.e., the distance between the end 17 and the open end 22 of the parasitic element 20) is a variable parameter "d". Except for the length and the separation mentioned above, the model shown in FIG. 13 is a same as the model 1 shown in FIG. 6.

Figure 14:
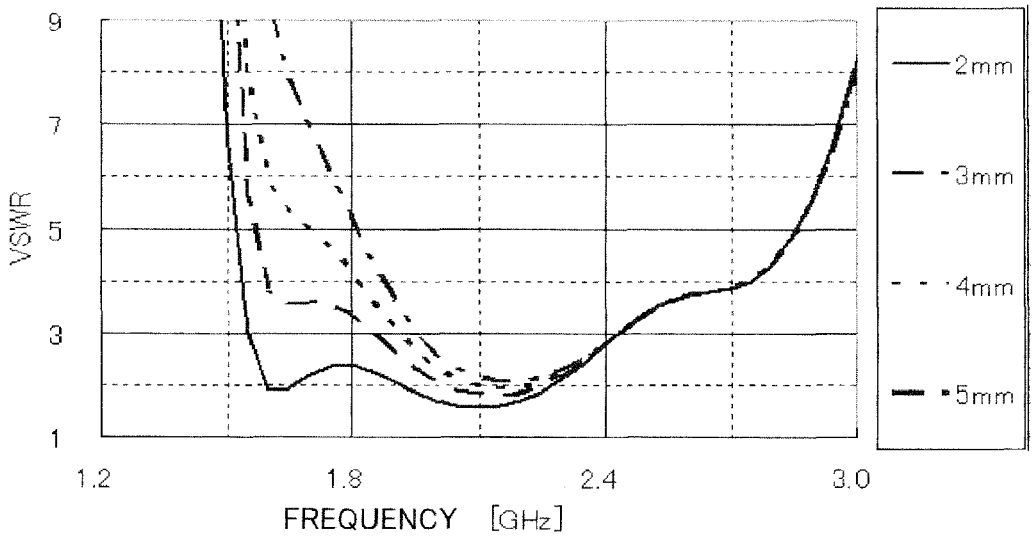
FIG. 14 is a graph of a frequency characteristic of a VSWR of the model shown in FIG. 13 in the 1.2 to 3 GHz frequency range estimated by simulation, where d=2 to 5 mm.

FIG. 14 is a graph of a frequency characteristic of a VSWR of the model shown in FIG. 13 at the feed portion 10 in the 1.2 to 3 GHz frequency range estimated by simulation, where d=2 to 5 mm. FIG. 14 has a horizontal axis and a vertical axis representing the frequencies and the VSWR, respectively. Solid, dashed, dotted and dot-and-dash curves represent the characteristics where d=2, 3, 4 and 5 mm, respectively.

Figure 15:
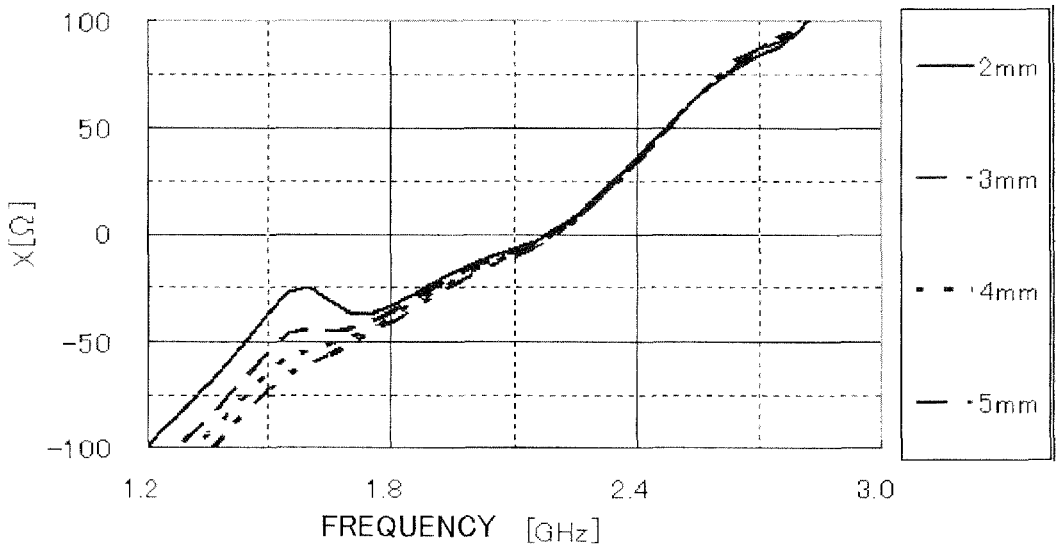
FIG. 15 is a graph of a frequency characteristic of an imaginary part of antenna impedance of the model shown in FIG. 13 in the 1.2 to 3 GHz frequency range estimated by simulation, where d=2 to 5 mm.

FIG. 15 is a graph of a frequency characteristic of an imaginary part of antenna impedance of the model shown in FIG. 13 in the 1.2 to 3 GHz frequency range estimated by simulation, where d=2 to 5 mm. FIG. 15 has a horizontal axis and a vertical axis representing the frequencies and the imaginary part of the antenna impedance, respectively. Solid, dashed, dotted and dot-and-dash curves represent characteristics where d=2, 3, 4 and 5 mm, respectively.

As shown in FIGS. 14-15, it is necessary to set the parameter d to be no greater than 5 mm (which corresponds to one-fortieth wavelength of the frequency F5=1.5 GHz), and preferably no greater than 3 mm, so that the antenna device 1 may be resonant around 1.5-1.6 GHz.

Figure 16:
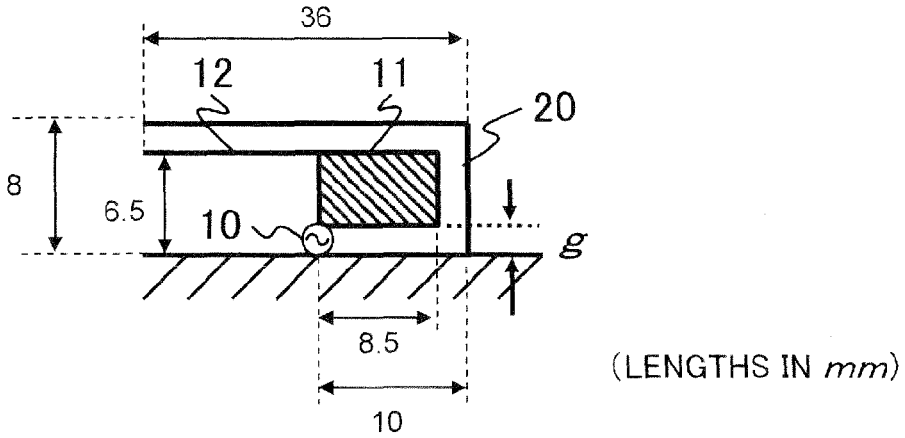
FIG. 16 is a plan view of a model of the antenna device of the first embodiment to be estimated by simulation in terms of an effect of a distance "g" between a lower side of the first partial element and a side of the ground conductor.

FIG. 16 is a plan view like FIG. 6 showing a shape and dimensions of a model to be estimated by simulation in terms of an effect of the distance between the lower side 13 of the first partial element 11 and the side of the ground conductor 3 on the frequency characteristic of the antenna device 1.

The model shown in FIG. 16 is a same as the model 1 shown in FIG. 6 except that the length between the feed portion 10 and the right end 16 of the lower side 13 of the first partial element 11 is 8.5 mm, and that the distance between the lower side 13 of the first partial element 11 and the side of the ground conductor 3 is a variable parameter "g". If g=2.5 mm, the earlier mentioned frequency F3 is 6 GHz.

Figure 17:
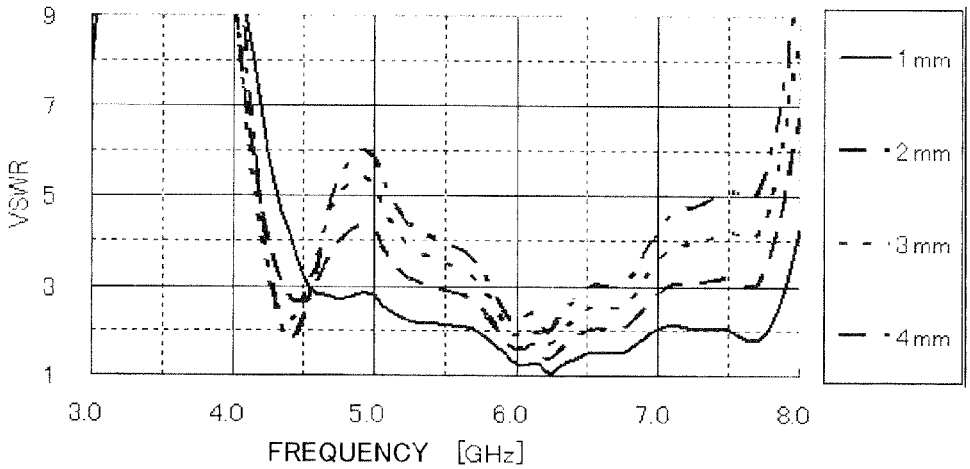
FIG. 17 is a graph of a frequency characteristic of a VSWR of the model shown in FIG. 16 in the 3 to 8 GHz frequency range estimated by simulation, where g=1 to 4 mm.

FIG. 17 is a graph of a frequency characteristic of a VSWR of the model shown in FIG. 16 in the 3 to 8 GHz frequency range estimated by the simulation, where g=1 to 4 mm. FIG. 17 has a horizontal axis and a vertical axis representing the frequencies and the VSWR, respectively. Solid, dashed, dotted and dot-and-dash curves represent characteristics where g=1, 2, 3 and 4 mm, respectively.

If g is 3 mm or above, as shown in FIG. 17, the VSWR becomes four or above at frequencies around 5 GHz and above 7 GHz, which is undesirable from a viewpoint of a broadband feature in a relatively high frequency range. Hence, g should be preferably no greater than 3 mm (which corresponds to one-twentieth wavelength of the frequency F3=6 GHz).

Figure 18:
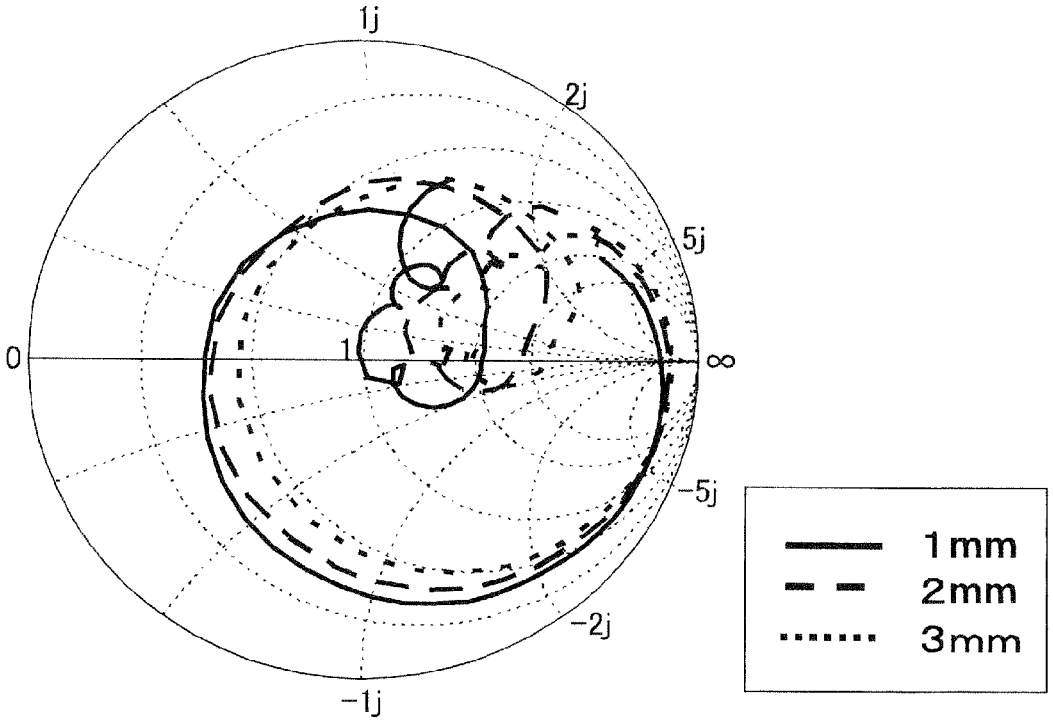
FIG. 18 is a Smith chart of impedance of the model shown in FIG. 16 in the 3 to 8 GHz frequency range where g=1 to 3 mm.

FIG. 18 is a Smith chart of impedance of the model shown in FIG. 16 in the 3 to 8 GHz frequency range where g=1 to 3 mm. For such values of g, as shown in FIG. 18, the model may obtain an impedance characteristic relatively close to a matching condition at resonant frequencies. As the Smith chart gives loci of the impedance which moves leftward and rightward as the value of g increases and decreases, respectively, the impedance may obviously be adjusted in the 3 to 8 GHz frequency range by adjustment of the value of g.

Figure 19:
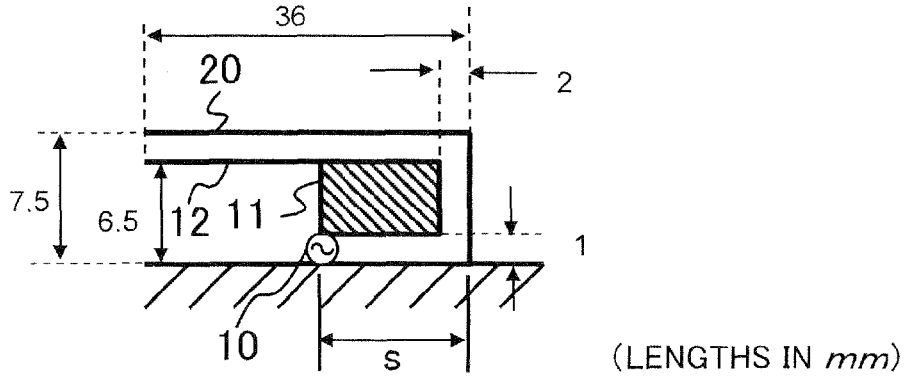
FIG. 19 is a plan view of a model of the antenna device of the first embodiment to be estimated by simulation in terms of an effect of a distance "s" between a feed portion and the grounded end of the parasitic element.

FIG. 19 is a plan view like FIG. 6 showing a shape and dimensions of a model to be estimated by simulation in terms of an effect of the distance between the grounded end 21 of the parasitic element 20 and the feed portion 10 on the frequency characteristic of the antenna device 1.

The first partial element 11 of the model of FIG. 19 is arranged 1 mm apart from the side of the ground conductor 3. The lower side 13 of the first partial element 11 between the feed portion 10 and the right end 16 has a length determined by a parameter "s" which will be described later. A length from the feed portion 10 to the branch portion 15 is 6.5 mm.

The grounded end 21 of the parasitic element 20 is arranged a distance "s" apart from the feed portion 10, and the open end 22 is arranged 7.5 mm apart from the side of the ground conductor 3. The parasitic element 20 is inverted and fallen sideways L shaped.

A horizontal portion of the inverted and fallen sideways L shape is 1 mm apart from, and parallel to, the upper side of the first partial element 11 (or the second partial element 12) facing thereto. A vertical portion of the inverted and fallen sideways L shape is 2 mm apart from, and parallel to, the right side of the first partial element 11 facing thereto. A length from a bend portion of the L shape to the open end 22 is 36 mm. The open end 22 and the end 17 of the second partial element 12 are vertically on a line.

Figure 20:
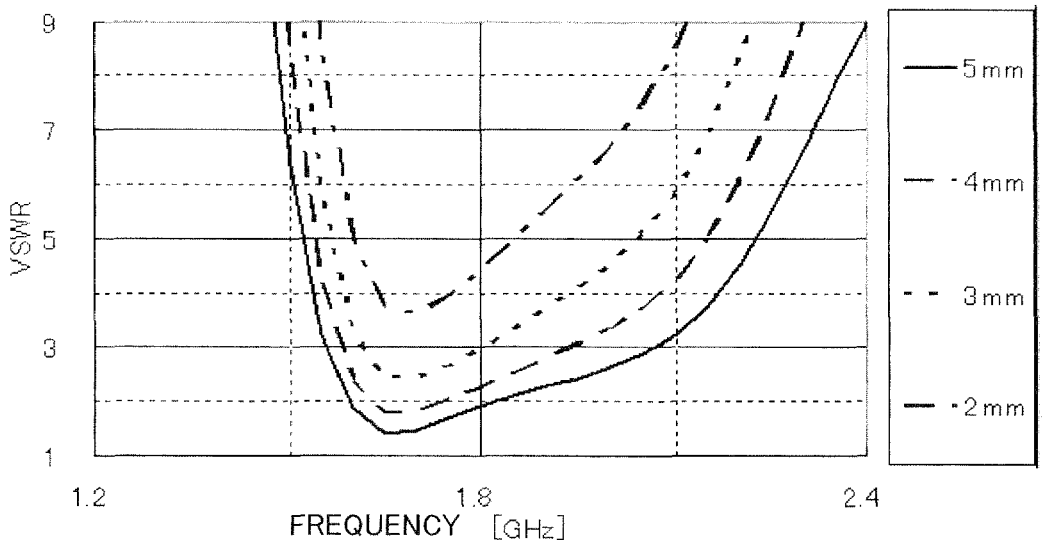
FIG. 20 is a graph of a frequency characteristic of a VSWR of the model shown in FIG. 19 in a 1.2 to 2.4 GHz frequency range estimated by simulation, where s=2 to 5 mm.

FIG. 20 is a graph of a frequency characteristic of a VSWR of the model shown in FIG. 19 at the feed portion 10 in a 1.2 to 2.4 GHz frequency range estimated by the simulation, where s=2 to 5 mm. FIG. 20 has a horizontal axis and a vertical axis representing the frequencies and the VSWR, respectively. Solid, dashed, dotted and dot-and-dash curves represent characteristics where s=5, 4, 3 and 2 mm, respectively.

Figure 21:
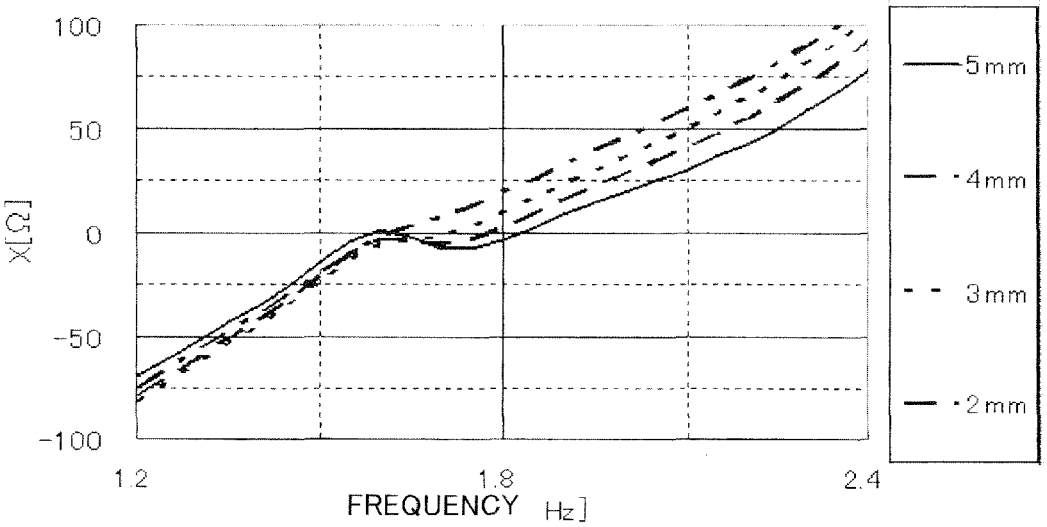
FIG. 21 is a graph of a frequency characteristic of an imaginary part of antenna impedance of the model shown in FIG. 19 in the 1.2 to 2.4 GHz frequency range estimated by simulation, where d=2 to 5 mm.

FIG. 21 is a graph of a frequency characteristic of an imaginary part of antenna impedance of the model shown in FIG. 19 in the 1.2 to 2.4 GHz frequency range estimated by the simulation, where s=2 to 5 mm. FIG. 21 has a horizontal axis and a vertical axis representing the frequencies and the imaginary part of the antenna impedance, respectively. Solid, dashed, dotted and dot-and-dash curves represent characteristics where s=5, 4, 3 and 2 mm, respectively.

As shown in FIGS. 20-21, it is necessary to set the parameter s to be no less than 2 mm (which corresponds to one-hundredth wavelength of the frequency F5=1.5 GHz) so that the antenna device 1 may be resonant around 1.5-1.6 GHz.

The first embodiment may be modified so that the open end 22 is open around at least a portion of the second partial element 12 other than the end 17. If the parasitic element 20 may be voltage-coupled to the second partial element 12, the above description of the first embodiment may also be applied to such a modification.

According to the first embodiment of the present invention described above, the antenna device may be formed by the first partial element, the second partial element and the parasitic element, and may enjoy a broadband feature e.g., in 1.5 to 2.7 GHz and 5 to 8 GHz frequency bands by selecting the shapes, dimensions and relative positions of each of the portions.

A second embodiment of the present invention will be described with reference to FIGS. 22-41. The second embodiment includes plural modifications of each of the portions of the antenna device 1 of the first embodiment. Each of the modifications will be described with an associated drawing.

For convenience of explanation, each of main portions of each of the modifications is given a same reference numeral as the corresponding one of the first embodiment, such as the ground conductor 3, the feed portion 10, the first partial element 11, the second partial element 12, and the parasitic element 20 and so on.

Figure 22:
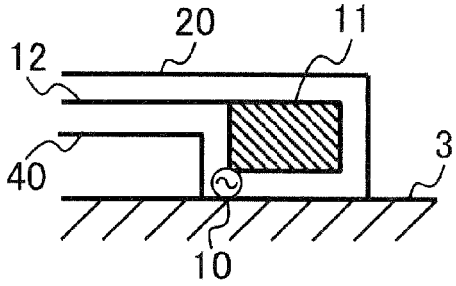
FIG. 22 is a plan view showing a configuration of an antenna device of a second embodiment of the present invention having an additional parasitic element.

FIG. 22 is a plan view of a modification including an additional parasitic element 40 added to the antenna device 1. The additional parasitic element 40 has an end grounded around the feed portion 10 and another end being open. The additional parasitic element 40 may be current-coupled to the left side portion of the first partial element 11 and has a resonant frequency determined by an element length. The modification shown in FIG. 22 may have more resonant frequencies than the antenna device 1 of the first embodiment by having the additional parasitic element 40.

Figure 23:
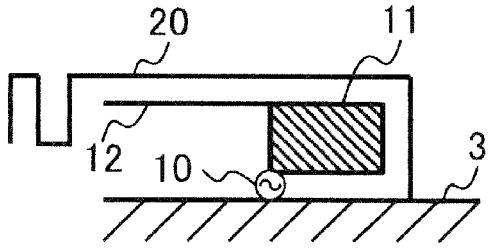
FIG. 23 is a plan view showing a configuration of an antenna device of the second embodiment having an extended and meander-shaped parasitic element.

FIG. 23 is a plan view of a modification where the whole length of the parasitic element 20 is extended longer than that of the antenna device 1 of the first embodiment. The portion including the open end 22 of the parasitic element 20 is meander-shaped. The modification shown in FIG. 23 may have a resonant frequency which is lower than the resonant frequency of the antenna device 1 by extending the whole length of the parasitic element 20.

Figure 24:
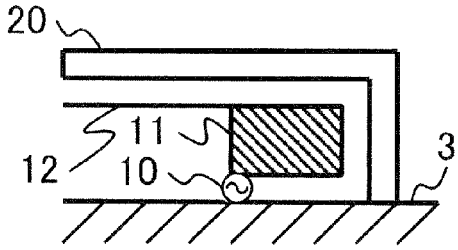
FIG. 24 is a plan view showing a configuration of an antenna device of the second embodiment having a folded monopole type parasitic element.

FIG. 24 is a plan view of a modification where the parasitic element 20 is folded and grounded at both ends. By forming the parasitic element 20 like a folded monopole type antenna, the modification shown in FIG. 24 may have a folded monopole like feature of higher antenna impedance in a relatively low frequency range.

Figure 25:
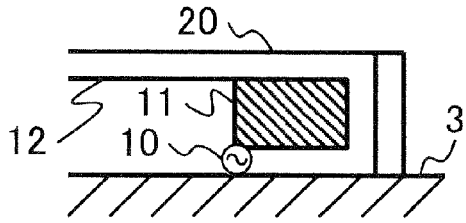
FIG. 25 is a plan view showing a configuration of an antenna device of the second embodiment having an inverted F type parasitic element.
Figure 26:
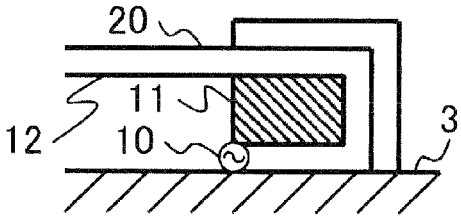
FIG. 26 is a plan view showing a configuration of an antenna device of the second embodiment having a parasitic element of an intermediate feature between the folded monopole type and the inverted F type.

FIG. 25 is a plan view of a modification where a portion of the parasitic element 20 not very far from the grounded end 21 is grounded. By having the parasitic element 20 formed like an inverted F type antenna, the modification shown in FIG. 25 may have an inverted F like feature of improved impedance matching in a relatively low frequency range. Another modification shown in FIG. 26 is a combination of the modifications shown in FIGS. 24-25 having an intermediate characteristic between the folded monopole type and the inverted F type.

Figure 27:
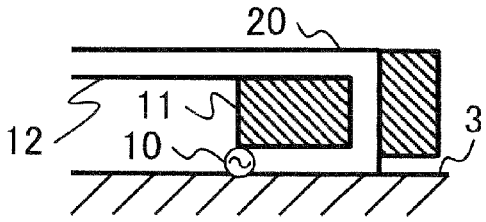
FIG. 27 is a plan view showing a configuration of an antenna device of the second embodiment having a partially wide parasitic element.
Figure 28:
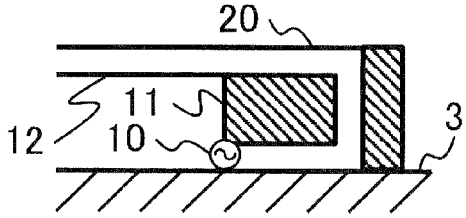
FIG. 28 is a plan view showing a configuration of an antenna device of the second embodiment having another partially wide parasitic element.

FIG. 27 or 28 is a plan view of a modification where a portion of the parasitic element 20 not very far from the grounded end 21 is shaped relatively wide. The parasitic element 20 shaped as shown in FIG. 27 or FIG. 28 may also have a resonant frequency determined by the path length between the grounded end 21 and the open end 22 of the parasitic element 20.

Figure 29:
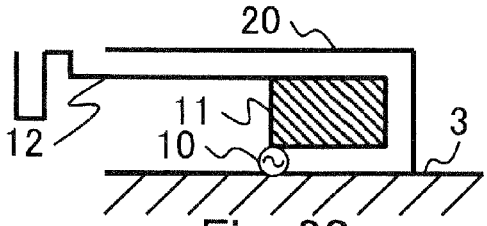
FIG. 29 is a plan view showing a configuration of an antenna device of the second embodiment having an extended and meander-shaped second partial element.

FIG. 29 is a plan view of a modification where the whole length of the second partial element 12 is extended longer than that of the antenna device 1 of the first embodiment. The portion including the end 17 of the second partial element 12 is meander-shaped. As a result, the modification shown in FIG. 29 may lower the resonant frequency depending on the length of the second partial element 12.

Figure 30:
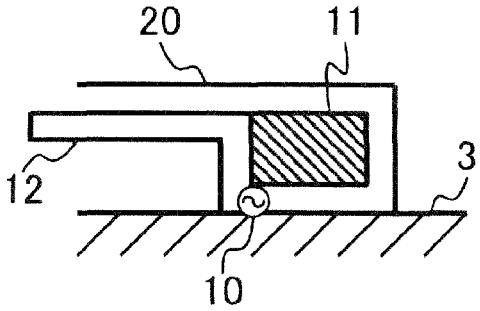
FIG. 30 is a plan view showing a configuration of an antenna device of the second embodiment having a folded monopole type second partial element.
Figure 31:
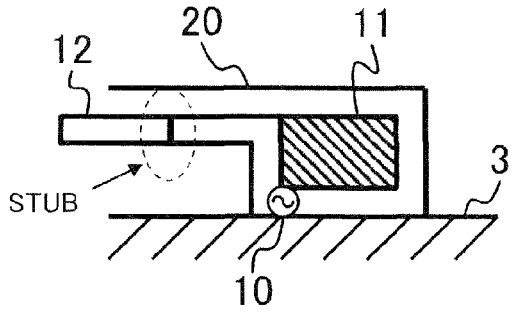
FIG. 31 is a plan view showing a configuration of an antenna device of the second embodiment modified from FIG. 30 by being added a stub of a first partial element.

FIG. 30 is a plan view of a modification where the second partial element 12 is folded and grounded at the end. By forming the second partial element 12 like a folded monopole type antenna, the modification shown in FIG. 30 may have a folded monopole like feature of higher antenna impedance at a frequency depending on the length of the second partial element 12. As shown in FIG. 31, the modification of FIG. 30 may be further modified in such a manner as to have portions on both sides of a fold portion short-circuited so as to work as a stub of the first partial element 11.

Figure 32:
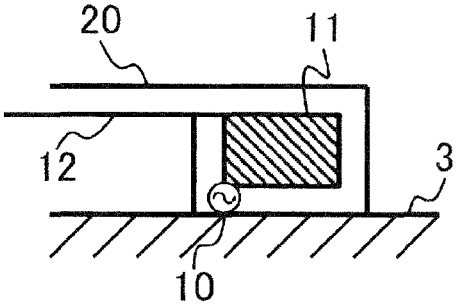
FIG. 32 is a plan view showing a configuration of an antenna device of the second embodiment having an inverted F type second partial element.
Figure 33:
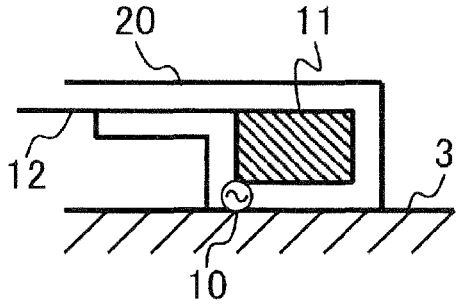
FIG. 33 is a plan view showing a configuration of an antenna device of the second embodiment having a second partial element of an intermediate feature between the folded monopole type and the inverted F type.

FIG. 32 is a plan view of a modification where a portion of the second partial element 12 not very far from the branch portion 15 where the second partial element 12 branches off from the first partial element 11 is grounded. By having the second partial element 12 formed like an inverted F type antenna, the modification shown in FIG. 32 may have an inverted F like feature of improved impedance matching at the frequency depending on the length of the second partial element 12. Another modification shown in FIG. 33 is a combination of the modifications shown in FIGS. 30 and 32 having an intermediate feature between the folded monopole type and the inverted F type.

Figure 34:
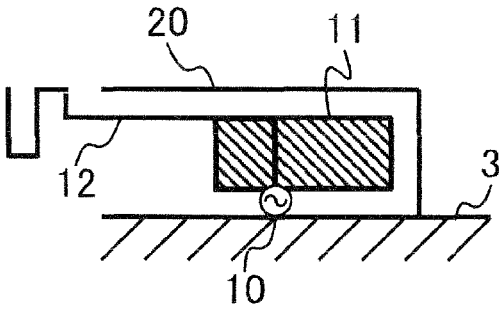
FIG. 34 is a plan view showing a configuration of an antenna device of the second embodiment having a wide shaped portion between the feed portion and the second partial element.
Figure 35:
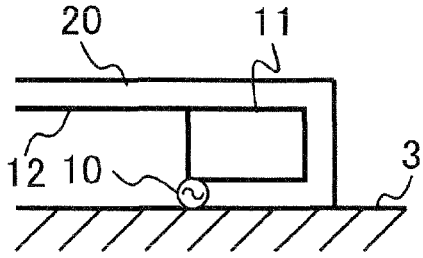
FIG. 35 is a plan view showing a configuration of an antenna device of the second embodiment having a first partial element shaped by fringe portions only.
Figure 36:
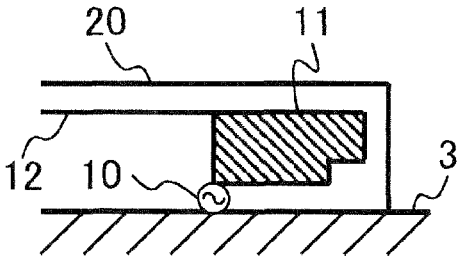
FIG. 36 is a plan view showing a configuration of an antenna device of the second embodiment having a deformed first partial element.
Figure 37:
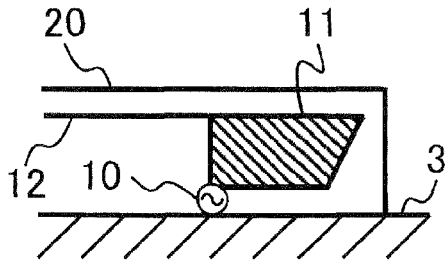
FIG. 37 is a plan view showing a configuration of an antenna device of the second embodiment having another deformed first partial element.
Figure 38:
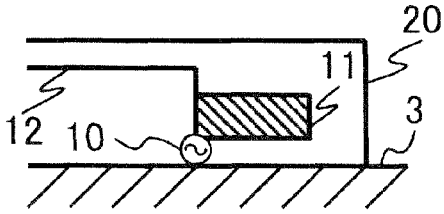
FIG. 38 is a plan view showing a configuration of an antenna device of the second embodiment having yet another deformed first partial element.

FIG. 34 is a plan view of a further modification of the modification shown in FIG. 29 where a portion between the second partial element 12 and the feed portion 10 is shaped relatively wide. FIG. 35 is a plan view of a modification where portions of the first partial element 11 other than the fringes have been removed. Each of other modifications shown in FIGS. 36-38 has the first partial element 11 variously deformed. The above modifications may have a same effect as the antenna device 1 of the first embodiment.

Figure 39:
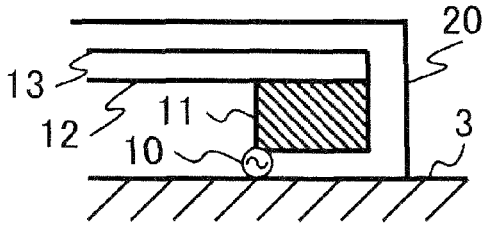
FIG. 39 is a plan view showing a configuration of an antenna device of the second embodiment having a third partial element.
Figure 40:
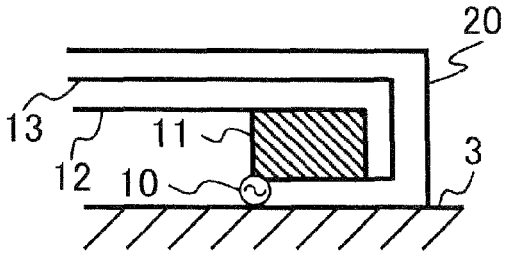
FIG. 40 is a plan view showing a configuration of an antenna device of the second embodiment having another third partial element.

FIG. 39 or 40 is a plan view of a modification further having a third partial element 13 which branches off from a fringe portion of the first partial element 11 and has an open end. The modification shown in FIG. 39 or 40 may have more resonant frequencies than the antenna device 1 of the first embodiment by having the third partial element 13.

Figure 41:
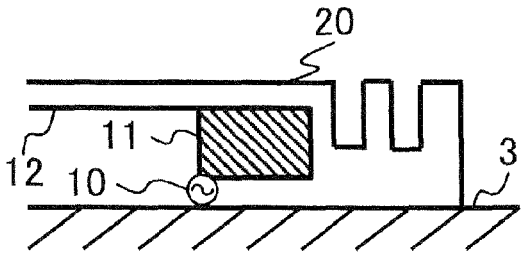
FIG. 41 is a plan view showing a configuration of an antenna device of the second embodiment having another extended and meander-shaped parasitic element.

FIG. 41 is a plan view of a modification where the whole length of the parasitic element 20 is extended longer than that of the antenna device 1 of the first embodiment and a portion close to the grounded end 21 is meander-shaped. As a result, the modification shown in FIG. 41 may lower the resonant frequency depending on the length of the parasitic element 20.

Various modifications of the antenna device 1 may be implemented other than the modifications described above. Yet another modification may be implemented by means of combination of some of the modifications described above, or of a lumped constant element to be loaded with.

According to the second embodiment of the present invention described above, the antenna device modified from the first embodiment in such a manner as to deform, add or combine the partial elements or the parasitic element may have not only a same effect as the first embodiment but an additional effect such as having more resonant frequencies.

In the descriptions of the above embodiments, each of the shapes, configurations and locations of the printed board, the antenna elements and the ground conductor, or each of the values provided as the conditions of the simulations, should be considered as exemplary only, and may be variously modified within a scope of the present invention.

The particular hardware or software implementation of the pre-sent invention may be varied while still remaining within the scope of the present invention. It is therefore to be understood that within the scope of the appended claims and their equivalents, the invention may be practiced otherwise than as specifically described herein.

What is claimed is:

1. An antenna device usable in a radio apparatus including a printed board, comprising:

a ground conductor of the printed board;

a first partial element shaped into an area having a first side facing a side of the ground conductor and a second side directed to cross the side of the ground conductor, the first partial element being provided with a feed portion around a first end of the first side which is closer to the second side, and a second end of the first side being apart from the side of the ground conductor;

a second partial element branching off from the first partial element around one of two ends of the second side being farther from the feed portion, the second partial element being directed almost against a direction from the feed portion to the second end of the first side which is farther from the second side; and a parasitic element having an end grounded around the second end of the first side.

2. The antenna device of claim 1, wherein the second partial element has an open end.

3. The antenna device of claim 1, wherein the parasitic element further has an open end arranged close to at least a portion of the second partial element.

4. The antenna device of claim 3, wherein the open end of the parasitic element is arranged separate from the portion of the second partial element by no greater than one-fortieth wavelength of a resonant frequency of the parasitic element.

5. The antenna device of claim 1, wherein the grounded end of the parasitic element is arranged separate from the feed portion by no less than one-hundredth wavelength of a resonant frequency of the parasitic element.

6. The antenna device of claim 1, wherein the first partial element is arranged in such a manner that a distance between the first side and the side of the ground conductor is no greater than one-twentieth wavelength of a resonant frequency determined by a path length including a distance between the feed portion and the second end of the first side.

7. The antenna device of claim 1 further comprising an additional parasitic element, the additional parasitic element having an end connected to the ground conductor around the feed portion.

8. The antenna device of claim 1, wherein at least one of the second partial element and the parasitic element is folded and further has another grounded end.

9. The antenna device of claim 1, wherein at least one of the second partial element and the parasitic element has an open end and a grounded middle portion.

10. A radio apparatus, comprising:

a printed board including a ground conductor; and an antenna, the antenna including:

a first partial element shaped into an area having a first side facing a side of the ground conductor and a second side directed to cross the side of the ground conductor, the first partial element being provided with a feed portion around a first end of the first side which is closer to the second side, and a second end of the first side being apart from the side of the ground conductor, a second partial element branching off from the first partial element around one of two ends of the second side being farther from the feed portion, the second partial element being directed almost against a direction from the feed portion to the second end of the first side which is farther from the second side, and a parasitic element having an end grounded around the second end of the first side.

11. The radio apparatus of claim 10, wherein the second partial element has an open end.

12. The radio apparatus of claim 10, wherein the parasitic element further has an open end arranged close to at least a portion of the second partial element.

13. The radio apparatus of claim 12, wherein the open end of the parasitic element is arranged separate from the portion of the second partial element by no greater than one-fortieth wavelength of a resonant frequency of the parasitic element.

14. The radio apparatus of claim 10, wherein the grounded end of the parasitic element is arranged separate from the feed portion by no less than one-hundredth wavelength of a resonant frequency of the parasitic element.

15. The radio apparatus of claim 10, wherein the first partial element is arranged in such a manner that a distance between the first side and the side of the ground conductor is no greater than one-twentieth wavelength of a resonant frequency determined by a path length including a distance between the feed portion and the second end of the first side.

16. The radio apparatus of claim 10, wherein the antenna further includes an additional parasitic element, the additional parasitic element having an end connected to the ground conductor around the feed portion.

17. The radio apparatus of claim 10, wherein at least one of the second partial element and the parasitic element is folded and further has another grounded end.

18. The radio apparatus of claim 10, wherein at least one of the second partial element and the parasitic element has an open end and a grounded middle portion.

* * * * *